United States Patent [19]

Kauffman

[11] 4,310,154

[45] Jan. 12, 1982

[54] EXERCISING DEVICE FOR THE FINGERS, WRIST AND FOREARM

[76] Inventor: Peter T. Kauffman, P.O. Box 75, Molalla, Oreg. 97038

[21] Appl. No.: 113,629

[22] Filed: Apr. 21, 1980

[51] Int. Cl.[3] ..... A63B 23/00

[52] U.S. Cl. ..... 272/67; 272/142; 273/1.5 A

[58] Field of Search ..... 272/67, 68, 142; 273/1.5 A

[56] References Cited

U.S. PATENT DOCUMENTS

| | | | |
|---|---|---|---|
| 440,837 | 11/1890 | Bonelli | 272/67 |
| 3,782,719 | 1/1974 | Kuhlman | 272/67 |
| 3,871,646 | 3/1975 | Slack | 272/142 |
| 4,039,183 | 8/1977 | Sakurada | 272/67 |

*Primary Examiner*—Richard J. Johnson
*Attorney, Agent, or Firm*—Eugene M. Eckelman

[57] ABSTRACT

An elongated rigid body member is arranged to receive a person's wrist and at least a portion of the forearm. An inverted bail is pivotally mounted on the front of the body member and is urged to an upward angular position with relation to the body member by springs, such bail having a finger engaging roller bar on its outer end. The device is arranged such that when anchored on a person's wrist and forearm and the fingers engaged over the roller bar, exercise for the person's fingers, wrist and forearm can be achieved by repeatedly pivoting the bail.

4 Claims, 4 Drawing Figures

FIG. 1
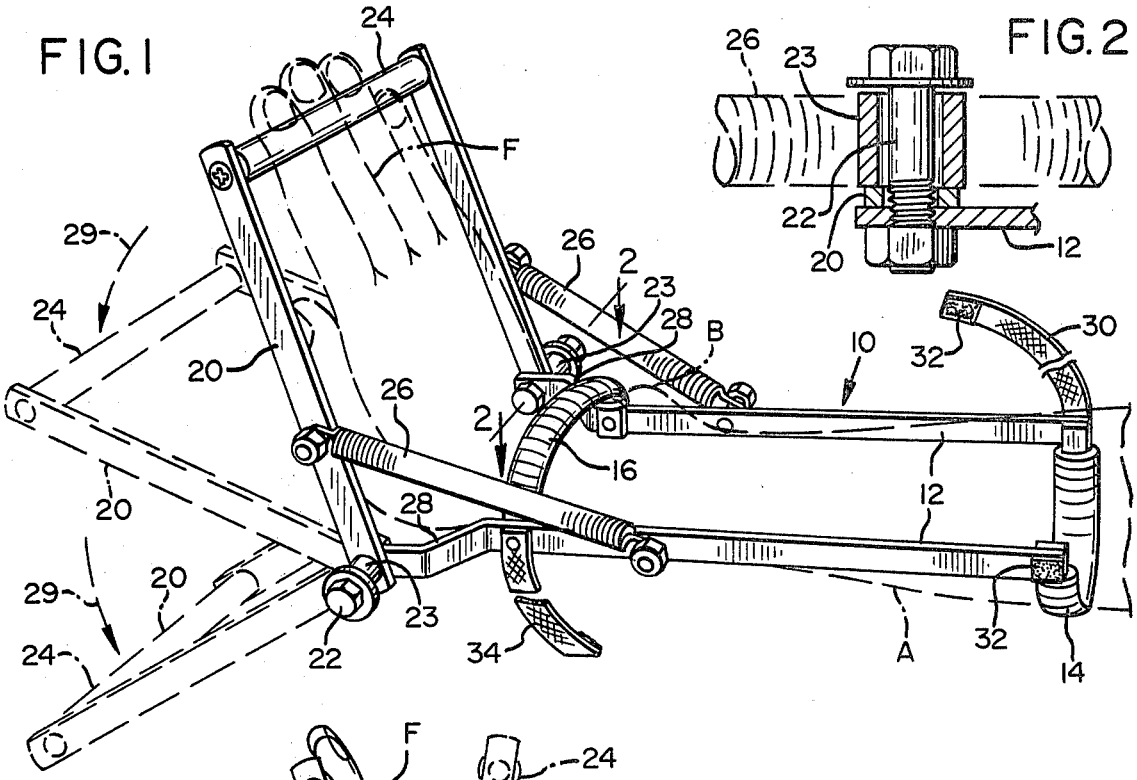
FIG. 2
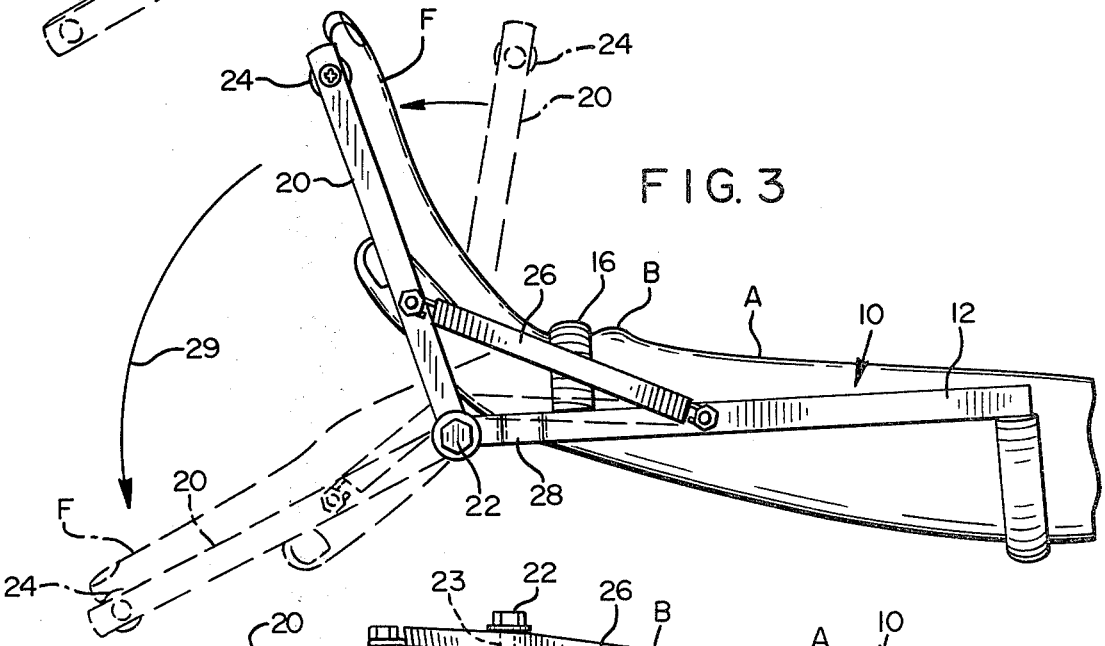
FIG. 3
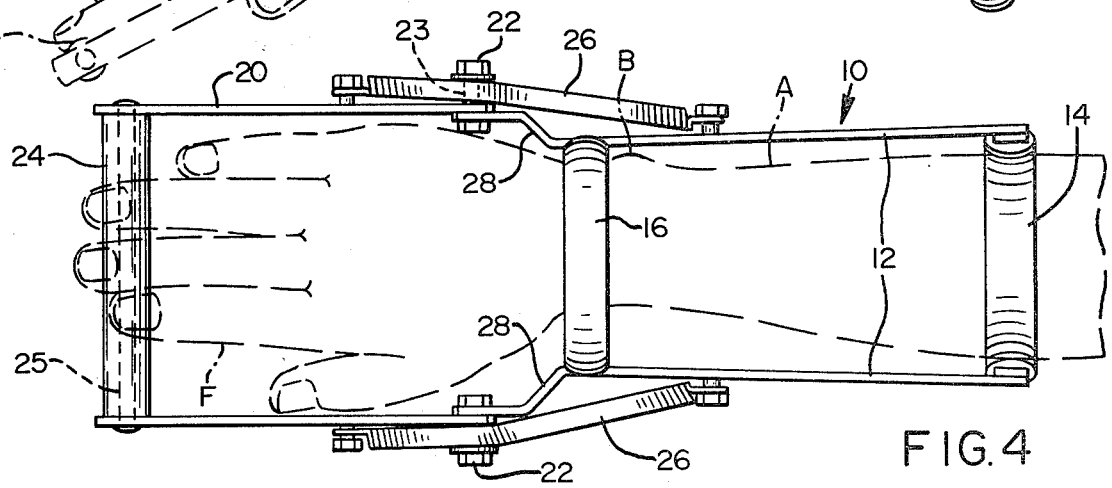
FIG. 4

EXERCISING DEVICE FOR THE FINGERS, WRIST AND FOREARM

BACKGROUND OF THE INVENTION

This invention relates to new and useful improvements in exercising devices and particularly pertains to a device for simultaneously exercising the fingers, wrist and forearm.

In many sports and other functions, it is required that the fingers, wrist and forearm be capable of expending a considerable force. One particular sport which requires a greater than average strength in the fingers, wrist and forearm is basketball and more particularly in one special shot wherein the basketball is held and balanced by both hands but one hand flips the ball in an arc toward the hoop. In such a shot, commonly called a push shot, the ball rolls off the ends of the fingers of the shooting hand, and in order to effectively perform such a shot, many hours of actual shooting practice must take place to build up the muscles in the fingers, wrist and forearm.

SUMMARY OF THE INVENTION

According to the present invention and forming a primary objective thereof, an exercising device is provided having a novel structure for exercising simultaneously the fingers of a person's hand, the wrist and the forearm, whereby required muscles can be built up without requiring actual gym practice.

It is an object of the present invention to provide such an exercising device which is designed particularly for developing muscles for flipping a basketball in an arc to the hoop by using one hand, wrist and forearm primarily as the propelling force.

In carrying out the invention, the device employs an elongated rigid body member having anchor means arranged to receive a person's wrist and at least a portion of the forearm. An inverted U-shaped lever is pivotally mounted on the forward end of the body member on a transverse axis, and such lever has laterally extending finger engaging means arranged for engagement with the palm side of the fingers adjacent the tips. Spring means urge the lever to a rest position which is angular to the longitudinal plane of the body, and such spring means resist rotation of the arm means toward a direction in longitudinal alignment with said body. The normal positioning of the lever by the spring means requires a person when mounting the device on his arm and wrist and positioning the palm side of his fingers on the finger engaging means to bend his wrist backwards whereby it requires force from the fingers, wrist and forearm to pivot the lever means against the spring means in a movement toward longitudinal alignment with the body member. The device has a selected anchored positioning on the arm such that the fingers move relative to the finger engaging means in a movement similar to the movement off of a basketball in a push shot toward the basket.

The invention will be better understood and additional objects and advantages will become apparent from the following description taken in connection with the accompanying drawings.

BRIEF DESCRIPTION OF THE DRAWINGS

FIG. 1 is a perspective view of the present exercising device, this view showing operational positions thereof in full and broken lines;

FIG. 2 is an enlarged fragmentary sectional view taken on the line 2—2 of FIG. 1;

FIG. 3 is a side elevational view of the exercising device, this view also showing operational positions thereof in full and broken lines; and FIG. 4 is a top plan view of the device.

DETAILED DESCRIPTION OF A PREFERRED EMBODIMENT

With particular reference to the drawings, the exercising device of the invention comprises a body member 10 including a pair of longitudinal rigid bars 12 secured together at the rearward end by a depending saddle-like frame member 14. Frame member 14 is padded.

The forward ends of the bars 12 are connected integrally in spaced relation by an upwardly arched frame member 16, this frame member also being padded and being disposed a short distance rearwardly of the front end of the body member.

An inverted U-shaped or bail-like lever 20 has its free ends connected to the forward ends of the bars 12 by transverse pivot bolts 22 having sleeve extensions 23 supported thereon at the outside portion of the bolts. The closed end of the bail-like lever 20 comprises a rotatably supported finger engaging roller bar 24. This bar is supported on a cross shaft 25.

Bail-like lever 20 is held in an upward angled position relative to the body member 10 by tension springs 26 connected between the lever 20 and the body member 10. The normal or rest position of lever 20 is at about a right angle to the body member. Such rest position is maintained in a counterclockwise rotation by the relaxed position of the springs. The space between the bars 12 of the body member 10 is sufficient to receive the arm A, and more particularly the forearm, therebetween, and the roller bar 24 is of sufficient width to be engaged by the first three fingers F of a person's hand, the bars 12 having an outward offset 28 adjacent the front to allow the bail-like lever 20 to accommodate a person's hand.

FIGS. 1, 3 and 4 show the exercising device anchored to the forearm and wrist in a use position, the body member 10 being of sufficient length to receive a substantial length of the forearm. In such anchored position, the hand and arm are inserted such that the forearm rests in the saddle 14 and the wrist extends under the arched frame member 16. The parts are dimensioned and arranged such that the arched frame member 16 engages the wrist on the forward side of the bone B. This bone anchors the device against rearward movement. The lever 20 is held upward at the rather steep angle by the springs 26 whereby when the palm side of the fingers is engaged with the roller bar 24, the wrist must be bend backward rather severely as shown in FIGS. 1 and 3.

In carrying out the exercising function, the person rotates the lever 20 against the action of the springs 26 in a counterclockwise direction 29 as viewed in FIGS. 1 and 3. As the lever 20 rotates even with or beyond longitudinal alignment with the body member 10, springs 26 engage or bend over sleeves 23 to prevent them from over-centering the spring force on the lever. The hand is then relaxed to allow the lever 20 to be returned by the springs, and such exercise is repeated as necessary to build up the muscles in the fingers, wrist and forearm. The body member 10 during the exercising functions bears upwardly against the forearm by means of the saddle 14 and bears downwardly on the wrist by means of the arched frame member 16. Engagement of the arched frame member 16 on the front side of the bone B anchors the device against rear thrust caused by the pressure of the finger tips on the roller bar 24. Such secures the device on the arm, although a top strap 30, FIG. 1, may have releasable connections 32, such as Velcro connections, with the body member adjacent the saddle 14 for providing a more positive attachment to the arm. Similarly, a bottom strap 34 may be associated with arched frame member 16.

With the pivot connections 22 disposed forwardly of the arched frame member 16, and with the arm attached so that the pivot point of the wrist is adjacent the frame member 16, the eccentric relation of the pivot connections 22 and the pivot point of the wrist will cause the roller bar 24 to move toward the fingertips as the pivot movement takes place. The operator thus initially selectively positions his arm so that in the down position of the lever 20, namely, a position substantially in longitudinal alignment with the body member 10 or beyond, as seen in broken lines in FIG. 3, the roller bar 24 will have travelled almost to the ends of the fingers, the fingers always remaining in a straightened condition. This association of the fingers with the roller bar 24 closely simulates the feel of a basketball as it moves off the propelling hand. At the same time, the required muscles in the fingers, wrist and forearm, are developed.

It is to be understood that the form of my invention herein shown and described is to be taken as a preferred example of the same and that various changes in the shape, size and arrangement of parts may be resorted to without departing from the spirit of my invention, or the scope of the subjoined claims. For example, springs may be combined in the pivot connections 22 instead of using the elongated tension springs 26. Also, body member 10 may comprise an elongated trough-shaped member provided with the upwardly arched cross member 16 at the font. The leg portions of the bail 20 may be adjustable in length to accommodate different hand sizes.

Having thus described my invention, I claim:

1. An exercising device for the fingers, wrist and forearm comprising (a) an elongated rigid body having forward and rearward ends, (b) said body being arranged to receive a person's wrist and a substantial portion of the forearm and including means arranged to anchor it thereon with said forward end disposed in approximately the area of the person's wrist and with said rearward end disposed a substantial distance from the wrist but short of the elbow, (c) said anchor means having spaced arm anchor points one of which is arranged to extend over a person's arm adjacent the wrist on the side of the arm opposite from the palm of the hand and the other of which is arranged to extend under a person's arm on the same side of the arm as the palm of the hand, (d) lever means pivotally attached at one of its ends adjacent the forward end of the body on a transverse axis, (e) laterally extending finger engaging means on the other end of said lever means arranged for engagement with the palm side of the fingers, (f) and spring means operatively connected between said body and said arm means, (g) said spring means urging said arm means to a rest position which is angular to the longitudinal plane of said body and resisting rotation of said arm means toward a direction in longitudinal alignment with said body, (h) said finger engaging means and its normal positioning by said spring means requiring a person when anchoring the arm and wrist to said body and positioning the palm side of the finger tips on said finger engaging means to bend the wrist backward, (i) said finger engaging means being spaced outwardly on said lever means from said pivot means such that with the fingers in straightened condition only the finger tips of the person's hand engage said finger engaging means, (j) whereby a person desiring to exercise the fingers, wrist and forearm anchors the arm to said body with the fingers engaged with said finger engaging means and the wrist bent backward and then forces said lever means against said spring means in a pivotal movement toward longitudinal alignment with said body with the finger tips in engagement with said finger engaging means and the fingers always remaining in straightened condition.

2. The exercising device of claim 1 wherein said anchor means is arranged to anchor said body on a person's wrist and forearm with said pivot attachment of said lever means forward of the person's wrist whereby the difference in longitudinal positioning of said pivot attachment with relation to the person's wrist causes said finger engaging means in its arc of movement to travel outward toward the finger tips.

3. The exercising device of claim 2 wherein said finger engaging means is rotatably supported on said lever means.

4. The exercising device of claim 1 wherein said anchor means includes a transverse depending saddle adjacent the rearward end of said body for engagement under the forearm and a transverse arcuate member adjacent the forward end of said body for engagement over the wrist.

* * * * *